US008211248B2

(12) United States Patent
Marya

(10) Patent No.: US 8,211,248 B2
(45) Date of Patent: Jul. 3, 2012

(54) AGED-HARDENABLE ALUMINUM ALLOY WITH ENVIRONMENTAL DEGRADABILITY, METHODS OF USE AND MAKING

(75) Inventor: Manuel P. Marya, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 45 days.

(21) Appl. No.: 12/371,727

(22) Filed: Feb. 16, 2009

(65) Prior Publication Data

US 2010/0209288 A1 Aug. 19, 2010

(51) Int. Cl.
*C22C 21/06* (2006.01)

(52) U.S. Cl. ..... 148/415; 420/542

(58) Field of Classification Search ..... 148/415; 420/542

See application file for complete search history.

(56) References Cited

U.S. PATENT DOCUMENTS

| | | | |
|---|---|---|---|
| 2,261,292 | A | 11/1941 | Salnikov |
| 2,279,136 | A | 1/1957 | Hood et al. |
| 3,106,959 | A | 10/1963 | Huitt et al. |
| 3,316,748 | A | 5/1967 | Lang et al. |
| 3,938,764 | A | 2/1976 | McIntyre et al. |
| 4,157,732 | A | 6/1979 | Fonner |
| 4,270,761 | A | 6/1981 | Hertz, Jr. |
| 4,450,136 | A | 5/1984 | Dudek et al. |
| 4,664,816 | A | 5/1987 | Walker |
| 4,906,523 | A | 3/1990 | Bilkadi et al. |
| 4,919,209 | A | 4/1990 | King |
| 5,188,183 | A | 2/1993 | Hopmann et al. |
| 5,204,183 | A | 4/1993 | McDougall et al. |
| 5,417,285 | A | 5/1995 | Van Buskirk et al. |
| 5,479,986 | A | 1/1996 | Gano et al. |
| 5,765,641 | A | 6/1998 | Shy et al. |
| 5,826,661 | A | 10/1998 | Parker et al. |
| 6,162,766 | A | 12/2000 | Muir et al. |
| 6,241,021 | B1 | 6/2001 | Bowling |
| 6,261,432 | B1 | 7/2001 | Huber et al. |
| 6,346,315 | B1 | 2/2002 | Sawatsky |
| 6,422,314 | B1 | 7/2002 | Todd et al. |
| 6,444,316 | B1 | 9/2002 | Reddy et al. |
| 6,457,525 | B1 | 10/2002 | Scott |
| 6,494,263 | B2 | 12/2002 | Todd |

(Continued)

FOREIGN PATENT DOCUMENTS

EP 178334 A1 4/1986

(Continued)

OTHER PUBLICATIONS

Thomson D.W., M.F. Nazroo—Design and Installation of a Cost-Effective Completion System for Horizontal Chalk Wells Where Multiple Zones Require Acid Stimulation—SPE Drilling & Completion, Sep. 1998, pp. 151-156.

*Primary Examiner* — Roy King
*Assistant Examiner* — Janelle Morillo
(74) *Attorney, Agent, or Firm* — Chadwick A. Sullivan; Rodney Warfford

(57) ABSTRACT

Disclosed herein is an aluminum alloy that is both age-hardenable and degradable in water-containing fluids. Some embodiments include aluminum alloy compositions with about 0.5 to 8.0 wt. % Ga (Gallium); about 0.5 to 8.0 wt. % Mg (Magnesium); less than about 2.5 wt. % In (Indium); and less than about 4.5 wt. % Zn (Zinc).

19 Claims, 8 Drawing Sheets

U.S. PATENT DOCUMENTS

| | | | |
|---|---|---|---|
| 6,527,051 | B1 | 3/2003 | Reddy et al. |
| 6,554,071 | B1 | 4/2003 | Reddy et al. |
| 6,561,270 | B1 | 5/2003 | Budde |
| 6,737,385 | B2 | 5/2004 | Todd et al. |
| 6,745,159 | B1 | 6/2004 | Todd et al. |
| 6,854,522 | B2 | 2/2005 | Brezinski et al. |
| 6,866,306 | B2 | 3/2005 | Boyle |
| 6,877,563 | B2 | 4/2005 | Todd et al. |
| 6,896,058 | B2 | 5/2005 | Munoz, Jr. et al. |
| 6,918,445 | B2 | 7/2005 | Todd et al. |
| 6,924,254 | B2 | 8/2005 | Todd |
| 6,968,898 | B2 | 11/2005 | Todd et al. |
| 6,971,448 | B2 | 12/2005 | Slabaugh et al. |
| 6,976,538 | B2 | 12/2005 | Wilson et al. |
| 6,983,798 | B2 | 1/2006 | Todd |
| 7,000,701 | B2 | 2/2006 | Todd et al. |
| 7,021,383 | B2 | 4/2006 | Todd et al. |
| 7,036,586 | B2 | 5/2006 | Roddy et al. |
| 7,036,588 | B2 | 5/2006 | Munoz, Jr. et al. |
| 7,036,687 | B1 | 5/2006 | Lowe |
| 7,044,220 | B2 | 5/2006 | Nguyen et al. |
| 7,285,772 | B2 | 10/2007 | Labous |
| 7,322,412 | B2 | 1/2008 | Badalamenti et al. |
| 7,322,417 | B2 | 1/2008 | Rytlewski et al. |
| 7,353,867 | B2 | 4/2008 | Carter et al. |
| 2003/0116608 | A1 | 6/2003 | Litwinski |
| 2003/0150614 | A1 | 8/2003 | Brown et al. |
| 2003/0224165 | A1 | 12/2003 | Anderson et al. |
| 2004/0043906 | A1 | 3/2004 | Heath et al. |
| 2004/0188090 | A1 | 9/2004 | Vaeth et al. |
| 2005/0145381 | A1 | 7/2005 | Pollard |
| 2005/0161222 | A1 | 7/2005 | Haugen et al. |
| 2005/0173126 | A1 | 8/2005 | Starr et al. |
| 2005/0194141 | A1 | 9/2005 | Sinclair et al. |
| 2005/0205264 | A1 | 9/2005 | Starr et al. |
| 2005/0205265 | A1 | 9/2005 | Todd et al. |
| 2005/0205266 | A1 | 9/2005 | Todd et al. |
| 2005/0241824 | A1 | 11/2005 | Burris, II et al. |
| 2005/0241835 | A1 | 11/2005 | Burris, II et al. |
| 2005/0269083 | A1 | 12/2005 | Burris, II et al. |
| 2006/0027359 | A1 | 2/2006 | Carter et al. |
| 2006/0035074 | A1 | 2/2006 | Taylor |
| 2006/0042835 | A1 | 3/2006 | Guerrero et al. |
| 2006/0175059 | A1 | 8/2006 | Sinclair et al. |
| 2006/0207771 | A1 | 9/2006 | Rios,III et al. |
| 2006/0249310 | A1 | 11/2006 | Stowe et al. |
| 2006/0266551 | A1 | 11/2006 | Yang |
| 2007/0034384 | A1 | 2/2007 | Pratt |
| 2007/0181224 | A1* | 8/2007 | Marya et al. ..... 148/400 |
| 2008/0018230 | A1 | 1/2008 | Yamada et al. |
| 2008/0105438 | A1 | 5/2008 | Jordan |
| 2008/0149345 | A1 | 6/2008 | Marya |
| 2008/0149351 | A1 | 6/2008 | Marya |
| 2008/0079485 | A1 | 7/2008 | Marya |

FOREIGN PATENT DOCUMENTS

| | | | |
|---|---|---|---|
| EP | 1605281 | | 12/2005 |
| GB | 666281 | A | 2/1952 |
| GB | 1187305 | A | 4/1970 |
| GB | 2386627 | A | 9/2003 |
| JP | 11264042 | A | 9/1999 |
| JP | 2002161325 | A | 6/2002 |
| RU | 2073696 | C1 | 2/1997 |
| WO | 200248503 | A1 | 6/2002 |
| WO | 2005090742 | A1 | 11/2005 |
| WO | 2006023172 | A2 | 3/2006 |
| WO | 2008079485 | A2 | 7/2008 |

* cited by examiner

AGED-HARDENABLE ALUMINUM ALLOY WITH ENVIRONMENTAL DEGRADABILITY, METHODS OF USE AND MAKING

BACKGROUND

Materials that react to external stimuli, for instances changes to their surrounding environments, have been the subject of significant research in view of the potential they offer to sectors of the economy as diverse as the medical, consumer-market, transportation, chemical and petrochemical sectors. For example, such an advanced material that would have the remarkable ability to degrade in order to actuate a well-defined function as a response to a change in its surrounding may be desirable because no or limited external human intervention would be necessary to actuate the function. Such a material, essentially self-actuated by changes in its surrounding (e.g., the presence or ingress of a specific fluid, or a change in temperature or pressure, among other possible changes) may potentially replace costly and complicated designs and may be most advantageous in situations where accessibility is limited or even considered to be impossible.

In a variety of subterranean and wellbore environments, such as hydrocarbon exploration and production, water production, carbon sequestration, or geothermal power generation, equipment of all sorts (e.g., subsurface valves, flow controllers, zone-isolation packers, plugs, sliding sleeves, accessories, etc) may be deployed for a multitude of applications, in particular to control or regulate the displacement of subterranean gases and liquids between subsurface zones. Some of these equipments are commonly characterized by relatively complex mechanical designs that are controlled remotely from the rig at ground level via wirelines, hydraulic control lines, or coil tubings.

Alternatively it may be desirable and economically advantageous to have controls that do not rely on lengthy and costly wirelines, hydraulic control lines, or coil tubings. Furthermore, in countless situations, a subterranean piece of equipment may need to be actuated only once, after which it may no longer present any usefulness, and may even become disadvantageous when for instance the equipment must be retrieved by risky and costly interventions. In such situations, the control or actuation mechanisms may be more conveniently imbedded within the equipment. In other applications, it may be beneficial to utilize the inherent ability of a material for reacting in the presence of an environmental change; for instance such a material may be applied to chemically sense the presence of formation water in a hydrocarbon well. In other foreseen applications, such a degradable material, if complemented by high mechanical strengths, may present new advantages in aquatic environments not only to withstand elevated differential pressures but also to control equipments deployed underwater with no or limited intervention.

In some instances, by way of example only, in the petroleum industry, it may be desirable to deploy a piece of equipment, apparatus, or device that performs a pre-determined function under differential pressures and then degrades such that the device no longer requires retrieval or removal by some method. By way of example only it may be advantageous to perform a multiple-stage oilfield operation such as that disclosed in U.S. Pat. No. 6,725,929. However, after the so-called ball, dart or plug is released in the wellbore to block gas and liquid transfers between isolated zones, it may be desirable to remove it by milling, flow-back, or alternate methods of intervention. In some instances, it may be simply more advantageous to manufacture equipments or devices, such as, by way of example only, balls, darts or plugs using a material that is mechanically strong (hard) and degrades under specific conditions, such as in the presence of water-containing fluids like fresh water, seawater, formation water, brines, acids and bases.

Unfortunately, the degradability of metallic materials, as defined by their lack of stability in a defined environment, as well as their ability to rapidly degrade (as opposed to the slow and uniform rusting or weight loss corrosion of steels for instance) may, in some instances, be accompanied with a number of undesirable characteristics. For example, among the very few metals that react and eventually fully degrade in water, both sodium metal and lithium metal, in addition to having low mechanical strengths, are water-reactive to the point they present great hazard along with great manufacturing, procurement, shipping and, handling challenges. Calcium metal is another reactive metal that in spite of being lesser reactive and slower to reacts than either sodium or lithium does not possess enough mechanical strength for normal engineering applications. Like sodium metal and lithium metal, calcium metal is thus unfit to many of the pressure-holding applications found for instances in the chemical and petroleum industries. When deficient, the properties of metals may be enhanced by alloying, meaning the chemical mixing of two or more metals and some other substances to form an end product, or alloy, with new properties that may be suitable for practical use. However, the alloying of lithium, sodium, or calcium metals with other metals and substances is not without major metallurgical and manufacturing challenges, and therefore the likelihood of creating an alloy with attractive engineering combinations of high strength, high toughness, and the proper degradability and rate of degradation (in a specific condition) is not only doubtful but also difficult to economically justify.

Table 1 compares several properties of pure metals with that of exploratory alloys in their annealed conditions (i.e., in the absence of cold working). Are listed in Table 1 measurements of hardness (Vickers hardness, as defined in the ASTM E370 standard) and galvanic corrosion potential, as simply established from voltage average readings of dissimilar metals and alloys electrically coupled by a aqueous electrolyte (here a sodium chloride enriched water). In this document, hardness and microhardness are considered to be fully interchangeable words; i.e., no distinction is made between the two words. Vickers hardness, or Vickers Microhardness, is a well-accepted and straight-forward measure that may be monotonically correlated to the mechanical strength of metals or alloys; e.g., the greater the hardness, the higher the mechanical strength of the material. Differently, galvanic corrosion potential is an electrochemical measure of reactivity, more precisely degradability, in an aqueous electrolytic environment, as produced by the coupling of materials with unlike chemical potentials. Though a low galvanic corrosion potential correlates to high degradability in water-containing fluid and often to high rates of degradation, rates of degradation are also influenced by other factors (e.g., water chemistry, temperature, pressure, and anode-to-cathode surface areas). Therefore, simplistically correlating rate of degradation to corrosion potential, despite being macroscopically correct as shown in Table 1, is not fully accurate for materials exhibiting especially comparable corrosion potentials. With these materials, factors such as temperature and water chemistry often have greater impacts on the rates of degradation than the galvanic corrosion potential itself. Galvanic corrosion potential and degradability may be considered purely as thermodynamic quantities, whereas rate of degradation is a kinetic quantity that is also influenced by other factors.

TABLE 1

| | Vickers hardness number (HVN) | Galvanic corrosion potential (Volts)* |
|---|---|---|
| Aluminum metal (99.99 wt. %) | 33.3 | −0.60 |
| Magnesium metal (99.99 wt. %) | 32.5 | −0.90 |
| Calcium metal (99.99 wt. %) | 23.1 | −1.12 |
| 80Al—10Ga—10In** | 33.4 | −1.48 |
| 80Al—5Ga—5Zn—5Bi—5Sn** | 33.7 | −1.28 |
| 75Al—5Ga—5Zn—5Bi—5Sn—5Mg** | 40.0 | −1.38 |
| 65Al—10Ga—10Zn—5Bi—5Sn—5Mg** | 39.2 | −1.28 |

*Galvanic corrosion potential was measured against a pure copper electrode (99.99 wt. %) in a 5 percent by eight sodium chloride aqueous solution; i.e., 5 wt. % NaCl in water.
**All alloy compositions are listed in weight percent (wt. %); e.g. 80 wt. % Al—10 wt. % Ga—10 wt. % In.

Of all aluminum alloys, those referred as the "heat-treatable" alloys exhibit some of the most useful combinations of mechanical strength (hardness), impact toughness, and manufacturability; i.e., the ability to readily make useful articles of manufactures. These alloys are also characterized as being precipitation or age-hardenable because they are hardened or strengthened (the two words are interchangeable) by heat treatments that typically consist of three consecutive steps: (1) a solutionizing (solution annealing) heat-treatment for the dissolution of solid phases in a solid α-aluminum (α refers to pure aluminum's phase), (2) a quenching or rapid cooling for the development of a supersaturated α-aluminum phase at a given low temperature (e.g., ambient), and (3) an aging heat treatment for the precipitation either at room temperature (natural aging) or elevated temperature (artificial aging or precipitation heat treatment) of solute atoms within intra-granular phases. During aging, the solute atoms that were put into solid solution in the α-aluminum phase at the solutionizing temperature and then trapped by the quench are allowed to diffuse and form atomic clusters within the α-aluminum phase. These clusters or ultra fine intra-granular phases result in a highly effective and macroscopic strengthening (hardening) that provides some of the best combinations of mechanical strength and impact toughness.

An important attribute of age-hardenable alloys is a temperature-dependent equilibrium solid solubility characterized by increasing alloying element solubility with increasing temperature (up to a temperature above which melting starts). The general requirement for age hardenability of supersaturated solid solutions involves the formation of finely dispersed precipitates during aging heat treatment. The aging must be accomplished not only below the so-called equilibrium solvus temperature, but below a metastable miscibility gap often referred as the Guinier-Preston (GP) zone solvus line. For the development of optimal mechanical properties, age-hardening alloys must therefore be heat-treated according to predetermined temperature vs. time cycles. Failures in following an appropriate heat-treatment cycle may result in only limited strengthening (hardening); however any strengthening (hardening) would still be evidence of an aging response. The presence of age-hardening novel aluminum alloys that possess the unusual ability to degrade in water-containing fluids is a large part of the alloys disclosed herein.

SUMMARY

Disclosed herein are novel aged-hardenable aluminum alloys that are also characterized as degradable when in contact with water or a water-containing fluid.

Some embodiments include about 0.5-8.0 wt. % Ga; about 0.5-8.0 wt. % Mg; less than about 2.5 wt. % In; and less than about 4.5 wt. % Zn.

EXAMPLES

All alloys shown in Table 2 (including commercially available 6061 alloy) were prepared by induction melting. The alloys were either prepared from commercial alloys, within which alloying elements were introduced from pure metals, or from pure metals. The commercial alloys and the alloying elements were all melted, magnetically, and mechanically stirred in a single refractory crucible. All melts were subsequently poured into 3-in diameter cylindrical stainless steel moulds, resulting in solid ingots weighting approximately 300 grams. The alloy ingots were cross-sections, metallographically examined (results not shown herein), and hardness tested either directly after casting (i.e., in their as-cast condition after the ingots had reached ambient temperature) and/or after aging heat treatments. The induction furnace was consistently maintained at temperatures below 700° C. (1290° F.) to ensure a rapid melting of all alloying elements but also minimize evaporation losses of volatiles metals such as magnesium. Gaseous argon protection was provided in order to minimize the oxidation of the alloying elements at elevated temperatures and maintain a consistency in the appearance of the cast ingots. All ingots were solidified and cooled at ambient temperature in their stainless steel moulds.

Solutionizing (solution annealing) was subsequently conducted at 454° C. (850° F.) for 3 hours to create a supersaturated solution. For purposes of simplifications, all alloys were solutionized at this single temperature, even though in reality each alloy has its own and optimal solutionizing (solution annealing) temperature; i.e., each alloy has a unique temperature where solubility of the alloying elements is maximized, and this temperature is normally the preferred solutionizing temperature. Optimal solutionizing (solution annealing) temperatures are not disclosed in this document, as they remain proprietary.

Figure 1:
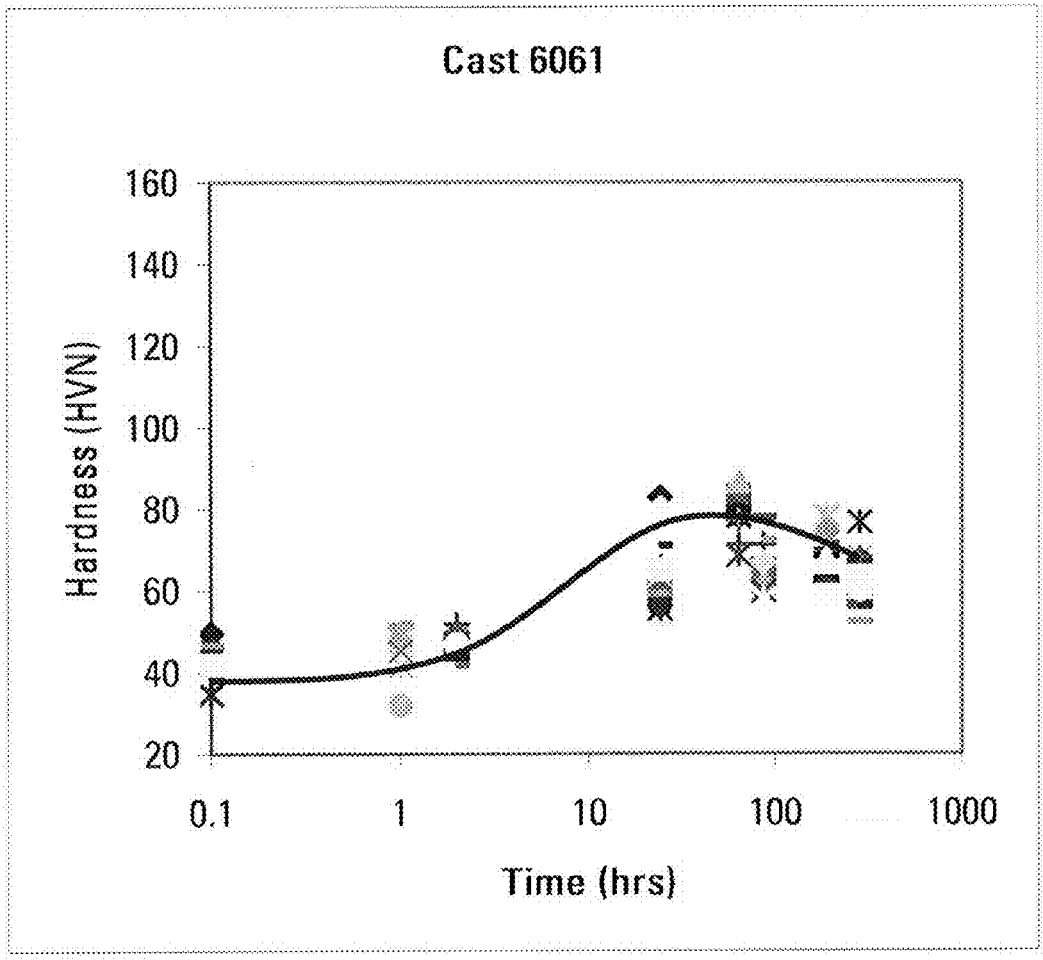
FIG. 1 is a graph of hardness versus time for alloy 6061.
Figure 2:
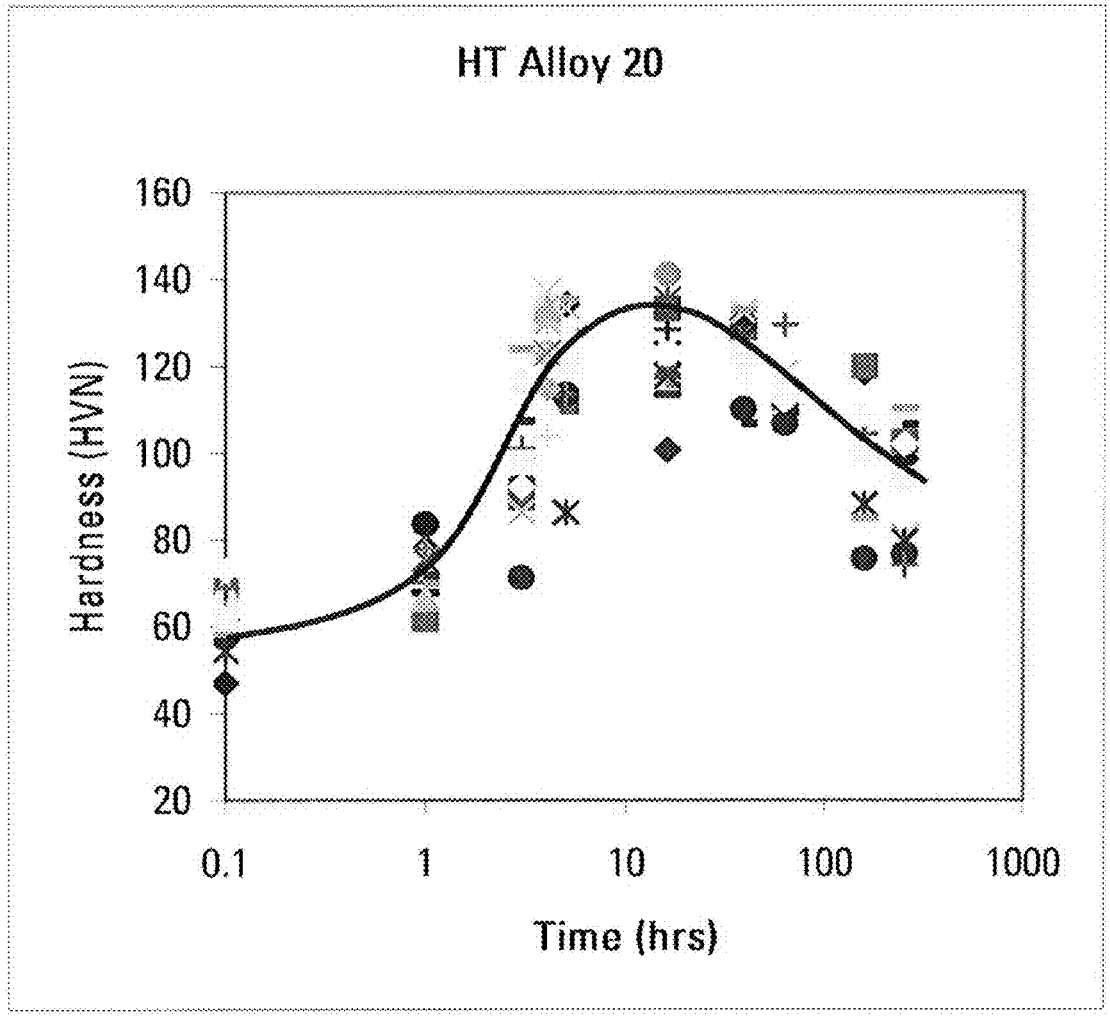
FIG. 2 is a graph of hardness versus time for disclosed HT Alloy 20.

Immediately after solutionizing (solution annealing), the alloys were oil quenched (fast cooled) to retain their supersaturated state at ambient temperature, and then aged at 170° C. (340° F.) in order to destabilize the supersaturated state and force the formation of a new and harder microstructure with fine precipitates dispersed within an α-aluminum matrix phase. Grain boundary-phase were also observed, but their consequences on alloy properties are not discussed herein, since not relevant to the invention. Vickers microhardness measurements, carried out with 500 g load in accordance with the ASTM E370 standard, were measured at various stages of the aging heat-treatment all across ingot cross-sections. Though herein are only reported the arithmetic averages of the hardness readings, at least ten microhardness measurements were conducted at each stage of the aging heat treatment. Hardness was monitored over time for as long as several weeks with the intention to fully replicate the aging of an alloy in a warm subterranean environment. Hardness vs. time curves were generated to quantify and compare the age-hardening response of the different alloys, as well as the stability of the formed precipitates. FIGS. 1 and 2 compares hardness vs. time responses of 6061 and HT alloy 20, a novel alloy disclosed in Table 2. Despite an evident scatter in the data plotted on FIGS. 1-2 that is characteristic of microstructural imperfections, the novel alloy of FIG. 2 is considerably harder (stronger), exhibiting an average and maximum hardness of about 120 compared to approximately 80 for the cast 6061 alloy in peak-aged condition. Like other well-known age-hardenable alloys, when heat-treated too long at temperatures or over-aged, the novel alloys then experience softening, in stark contrast to the hardening observed earlier during aging. Rapid decrease in hardness during over-aging is a direct indication that the formed precipitates are not thermally stable. In stark contrast, stable precipitates, as revealed by no or barely detectable hardness decay over time, may be preferred for most subterranean applications.

As a substitute to hardness vs. time curves (similar to that of FIGS. 1-2), important hardness results are instead summarized in Table 2 for all 26 novel alloys. Also included in Table 2 are their nominal chemical compositions. For comparison purpose, a 6061 alloy (i.e., a non-degradable and commercially-available aluminum alloy), remelted in the same conditions are the novel alloys is also included in Table 2. Reported in Table 2 are the as-cast hardness (a measure of the hardness after casting and with no subsequent heat-treatment of any sorts) and the peak hardness (i.e., the maximum hardness observed during aging heat treatment). An increase in hardness from as-cast to aged (heat-treated) conditions is an undeniable proof of age-hardenability.

In Table 2 the alloys are not categorized in the order they were formulated and thus shaped into ingots; instead they are ranked according to their magnesium content (in percent) to specifically demonstrate the contribution of magnesium as an alloying element. In Table 2, alloying element contents, expressed in percent by weight (wt. %) are as follows: 0.5 to 8.0 wt. % magnesium (Mg), 0.5 to 8.0 wt. % gallium (Ga), 0 to 2.5 wt. % indium (Ga), 0 to 2.3 wt. % silicon (Si), and 0 to 4.3 wt. % zinc (Zn).

Figure 3:
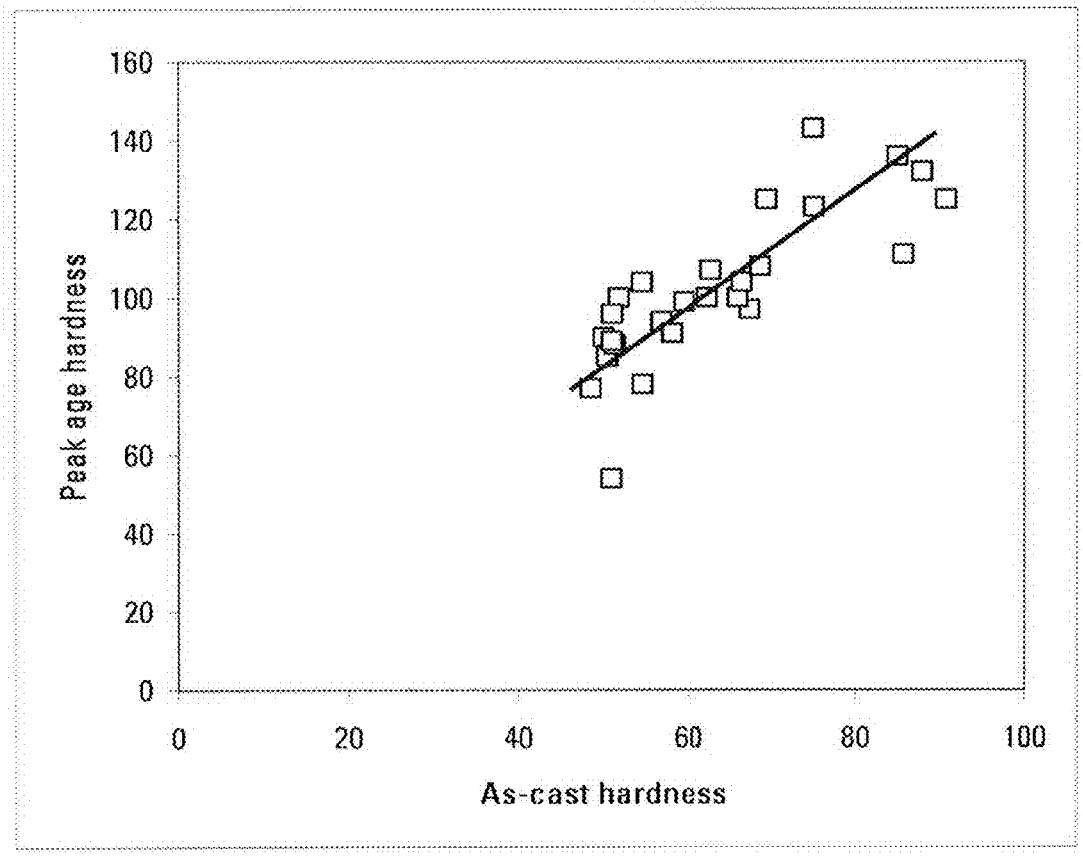
FIG. 3 is a graph of peak aged hardness versus as-cast hardness for disclosed alloys.
Figure 4:
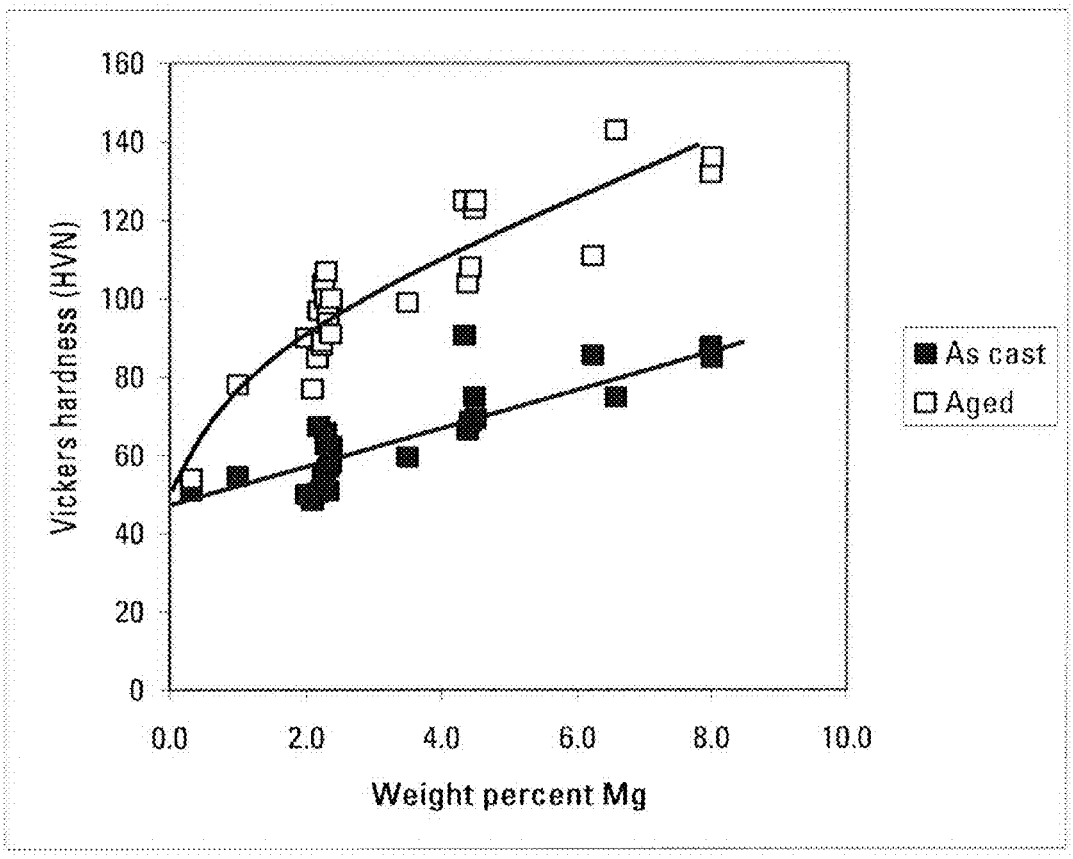
FIG. 4 is a graph of Vickers hardness versus weight percentage Mg for disclosed alloys.
Figure 5:
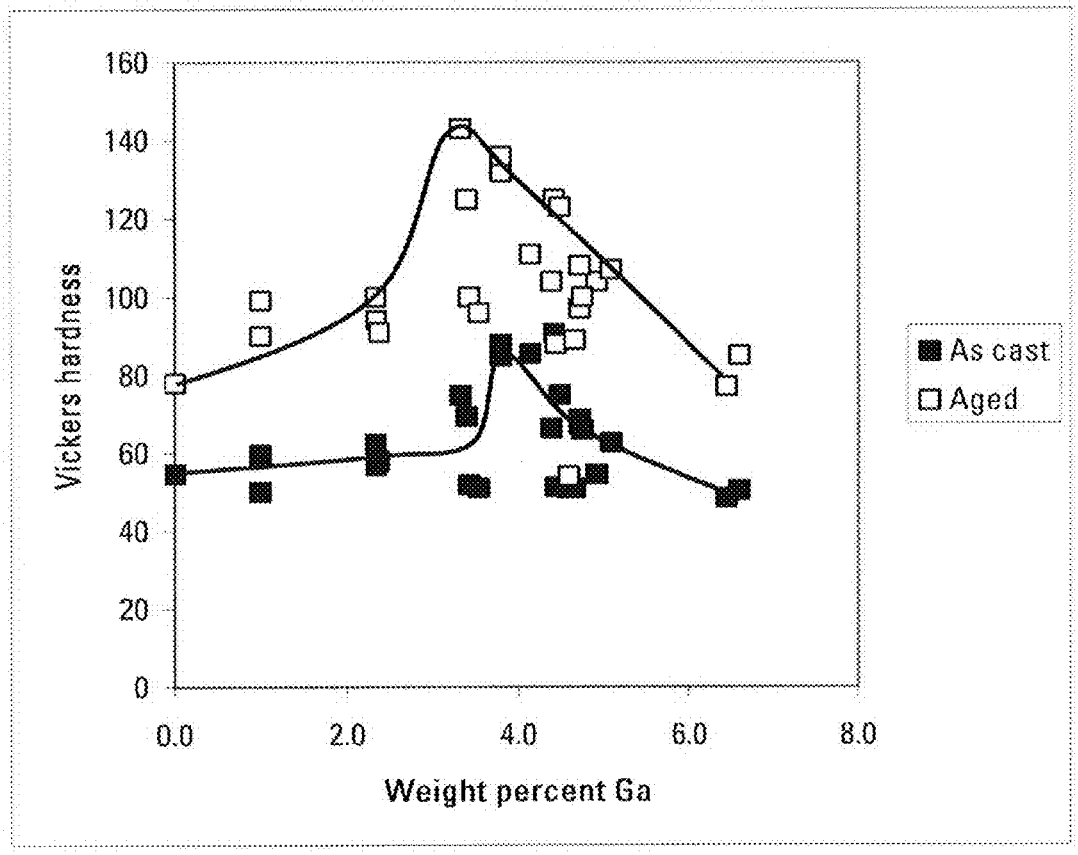
FIG. 5 is a graph of Vickers hardness versus weight percentage Ga for disclosed alloys.
Figure 8:
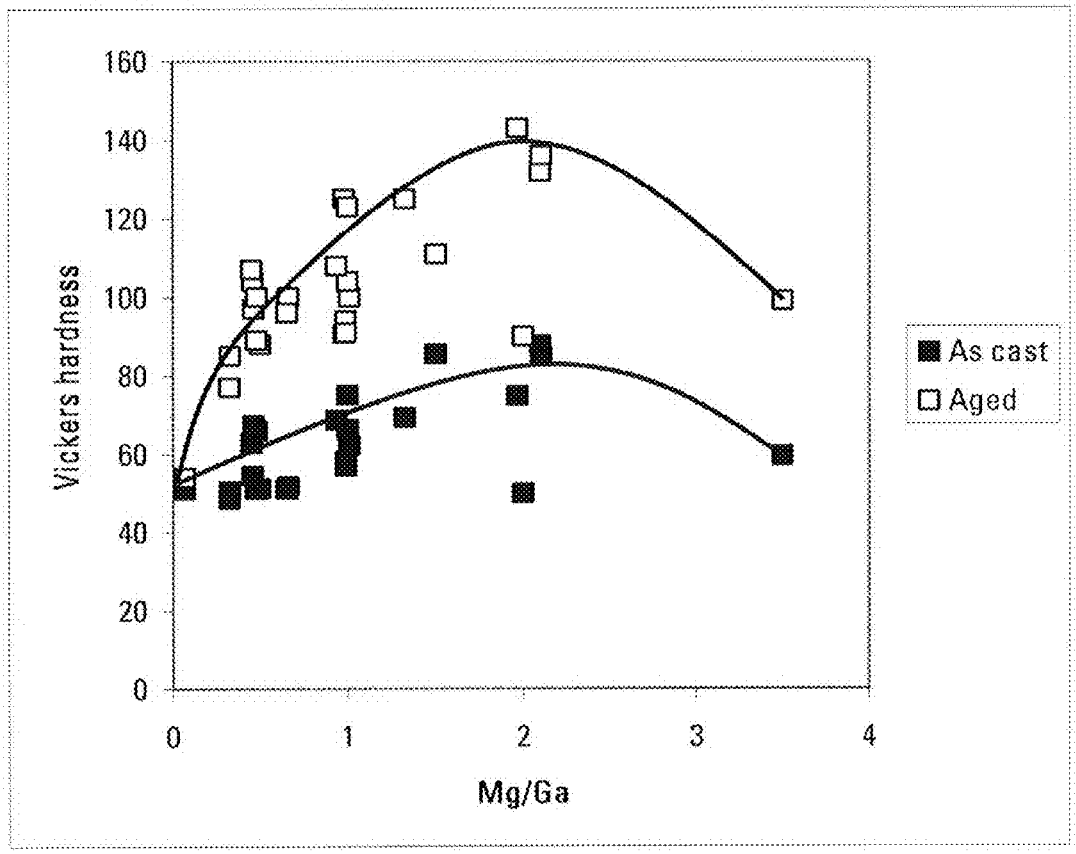
FIG. 8 is a graph of Vickers hardness versus Mg/Ga ratio for disclosed alloys.

All alloys were purposely formulated to demonstrate a wide range of magnesium and gallium, along with other alloying elements found in several series of commercial aluminum alloys, among others. FIG. 3, which depicts hardness results from all 26 alloys of Table 2, further reveals that all the novel alloys responded to age-hardening; i.e., they may be strengthened by heat-treatments as are commercial alloys such as the 6061 alloy. While magnesium is known to be an effective solid-solution hardening element that is essential to several commercial alloys, gallium is equally well-known for creating grain-boundary embrittlement by liquation; in other words gallium is known to lower mechanical strength (hardness), specifically by promoting a low-temperature creep-type deformation behavior. In fact in the prior art, gallium—like many low-melting point metals (mercury, tin, lead)—is considered to be detrimental to aluminum; thus gallium like other low-melting point elements is only present in commercial aluminum alloys in impurity levels; removal of these elements even in trace quantities has traditionally been chief in achieving high-quality aluminum alloys for industrial use. FIGS. 4 to 8 confirm that magnesium is also a key contributor in raising hardness in the inventive alloys, either in as-cast or aged condition (heat-treated condition). However, magnesium alone does not suffice to generate an elevated age hardening, unless magnesium is properly combined with gallium, as shown in FIGS. 5 and 8. The data show that hardness values well in excess to that of commercially-available 6061 may be achieved with appropriate combinations of magnesium and gallium (a peak hardness of 140 HVN, well in excess of the measured value in the 80s for the 6061 alloy is reported herein). Not only a maximum hardening occurs at intermediate gallium percentage, as shown in FIG. 5, the ratio of magnesium-to-gallium is also demonstrated to be important. A ratio of in the vicinity of 2 is shown to result in maximum hardness; for practical purposes, magnesium-to-gallium ratios between 0.5 and 3.5 may be recommended to create a variety of mechanical strengths and rates of degradation.

Figure 6:
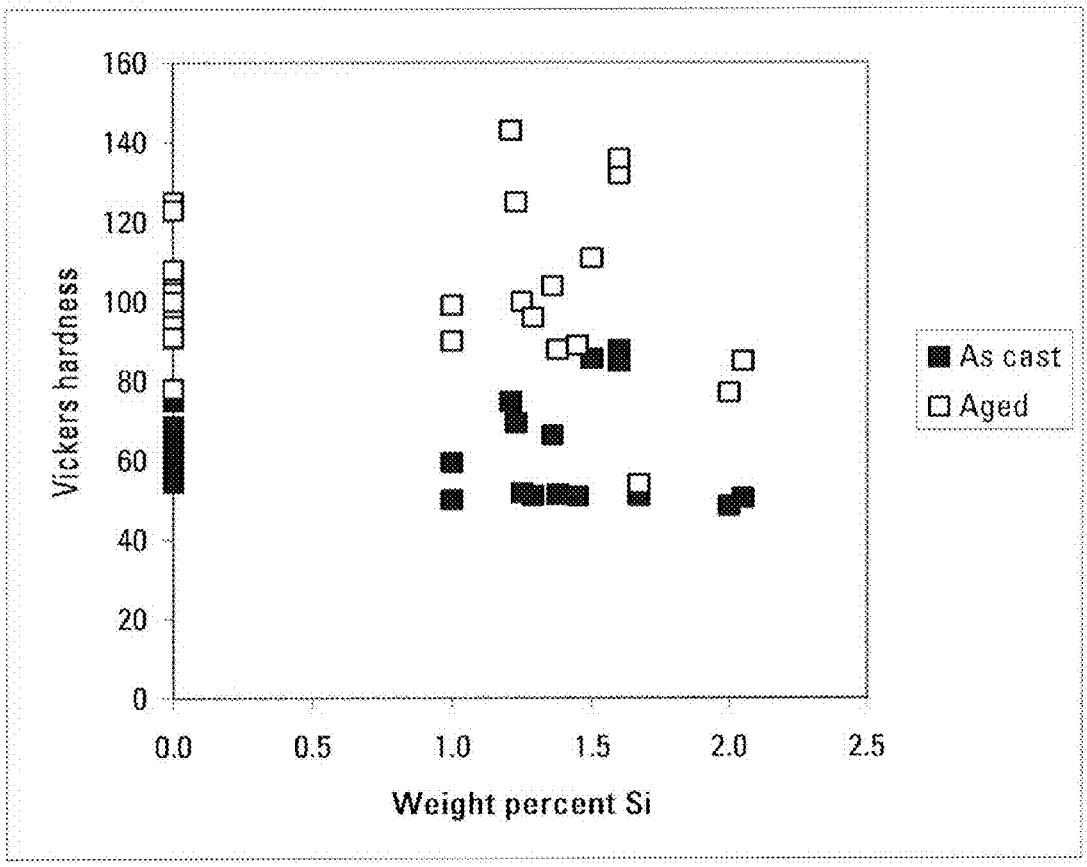
FIG. 6 is a graph of Vickers hardness versus weight percentage Si for disclosed alloys.
Figure 7:
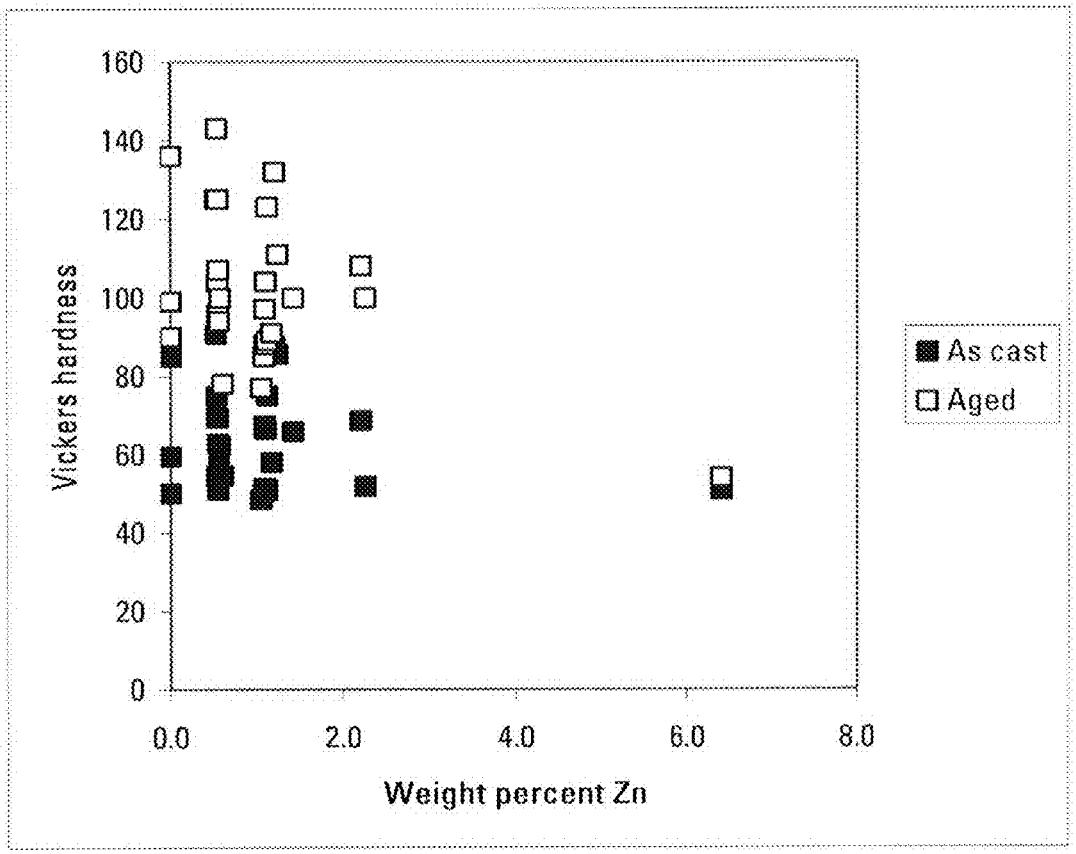
FIG. 7 is a graph of Vickers hardness versus weight percentage Zn for disclosed alloys.

Furthermore, as pointed out by FIG. 6, silicon (an element essential to alloy 6061 to cause age-hardening) is not seen to influence hardness measurably in any of the novel alloys. Unlike magnesium, zinc (FIG. 7) only appears to slightly reduce hardness, an indication that the addition of zinc in the alloys of this invention interferes with the aging heat-treatment and the magnesium-gallium alloying. The role of zinc in the novel alloys is thus quite different to that seen in typical commercial aluminum alloys. In many commercial aluminum alloys, zinc is utilized to produce high strength with suitable resistance against corrosion and stress-corrosion cracking.

TABLE 2

| | Mg (wt. %) | Ga (wt. %) | In (wt. %) | Si (wt. %) | Zn (wt. %) | Mg/Ga | As-cast HVN | HT to Peak HVN |
|---|---|---|---|---|---|---|---|---|
| 6061 - alloy | 1.0 | 0.0 | 0.0 | 0.6 | 0.1 | — | 55 | 78 |
| HT alloy 0 | 0.5 | 0.5 | 0.5 | 0.0 | 0.0 | 1.00 | 42 | 78 |
| HT alloy 1 | 0.5 | 1.0 | 1.0 | 0.0 | 0.0 | 0.50 | 42 | 78 |
| HT alloy 2 | 2.0 | 1.0 | 1.0 | 0.0 | 0.0 | 2.00 | 50 | 90 |
| HT alloy 3 | 2.1 | 6.5 | 2.5 | 1.1 | 4.2 | 0.32 | 49 | 75 |
| HT alloy 4 | 2.2 | 8.0 | 2.1 | 1.1 | 0.1 | 0.33 | 50 | 85 |
| HT alloy 5 | 2.2 | 4.7 | 0.0 | 1.1 | 4.4 | 0.46 | 67 | 97 |
| HT alloy 6 | 2.2 | 4.4 | 1.4 | 1.1 | 2.2 | 0.50 | 51 | 88 |
| HT alloy 7 | 2.2 | 4.7 | 1.5 | 1.1 | 0.1 | 0.48 | 51 | 89 |
| HT alloy 8 | 2.3 | 4.9 | 0.0 | 0.5 | 0.1 | 0.46 | 55 | 104 |
| HT alloy 9 | 2.3 | 3.4 | 1.3 | 2.3 | 0.1 | 0.66 | 52 | 100 |
| HT alloy 10 | 2.3 | 4.8 | 0.0 | 1.4 | 0.1 | 0.48 | 66 | 100 |
| HT alloy 11 | 2.3 | 5.1 | 0.0 | 0.6 | 0.1 | 0.45 | 63 | 107 |

TABLE 2-continued

| | Mg (wt. %) | Ga (wt. %) | In (wt. %) | Si (wt. %) | Zn (wt. %) | Mg/Ga | As-cast HVN | HT to Peak HVN |
|---|---|---|---|---|---|---|---|---|
| HT alloy 12 | 2.3 | 3.5 | 1.3 | 0.6 | 0.1 | 0.65 | 51 | 96 |
| HT alloy 13 | 2.3 | 2.4 | 0.0 | 0.6 | 0.1 | 0.99 | 57 | 94 |
| HT alloy 14 | 2.4 | 2.4 | 0.0 | 1.2 | 0.1 | 0.99 | 58 | 91 |
| HT alloy 15 | 2.4 | 2.3 | 0.0 | 0.6 | 0.1 | 1.01 | 62 | 100 |
| HT alloy 16 | 3.5 | 1.0 | 1.0 | 0.0 | 0.0 | 3.50 | 60 | 99 |
| HT alloy 17 | 4.3 | 4.4 | 0.0 | 0.5 | 4.3 | 0.98 | 91 | 125 |
| HT alloy 18 | 4.4 | 4.4 | 1.4 | 1.1 | 0.1 | 1.00 | 66 | 104 |
| HT alloy 19 | 4.4 | 4.7 | 0.0 | 2.2 | 0.1 | 0.94 | 69 | 108 |
| HT alloy 20 | 4.5 | 4.5 | 0.0 | 1.1 | 0.1 | 1.00 | 75 | 123 |
| HT alloy 21 | 4.5 | 3.4 | 1.2 | 0.5 | 0.1 | 1.32 | 69 | 125 |
| HT alloy 22 | 6.2 | 4.1 | 1.5 | 1.2 | 4.1 | 1.50 | 86 | 111 |
| HT alloy 23 | 6.6 | 3.3 | 1.2 | 0.5 | 0.1 | 1.97 | 75 | 143 |
| HT alloy 24 | 8.0 | 3.8 | 1.6 | 1.2 | 0.0 | 2.10 | 88 | 132 |
| HT alloy 25 | 8.0 | 3.8 | 1.6 | 0.0 | 0.0 | 2.11 | 85 | 136 |

* HT stands for heat-treatable. HVN stands for Hardness Vickers Number; here measured under a 500 g indentation load.

Galvanic corrosion potentials of several of the 26 alloys of Table 2 are summarized in Table 3. Galvanic corrosion potential is a valuable indicator of the degradability of the alloy in water-containing environments. Galvanic corrosion potential is here measured by connecting to a voltmeter two electrodes immersed in an electrically conductive 5 wt. % sodium chloride aqueous solution. One electrode is made of one of the test alloys, and the other of a reference material, here selected to be some commercially pure copper (e.g., 99.99% Cu). The voltage, directly read on the voltmeter was determined to be the galvanic corrosion potential. Most generally novel alloys characterized by galvanic corrosion potentials lesser than about −1.2 were observed to exhibit high degradabilities; i.e., they react with the surrounding fluid and produced a characteristic gaseous bubbling. For comparison purposes, galvanic corrosion potentials of magnesium and calcium are shown in Table 1 under the same exact test conditions. Some novel alloys were found to be calcium-like by being highly and rapidly degradable at ambient temperature, while others were found to only rapidly degrade in a calcium-like manner at elevated temperatures and despite the fact that their galvanic corrosion potential is lower than that of either magnesium or calcium. For those alloys not listed in Table 3 but included in Table 2, the measured corrosion potentials were between −1.25 and −1.45. Generally, the lowest potentials were for those alloys containing indium. It is clear from Table 3 that gallium and indium are both responsible for the degradability of the novel alloys while other elements tend to either enhance or reduce degradability and rates of degradation. With the alloys of this invention, the contribution of gallium is two-fold: gallium increases both hardness (strength) and degradability.

TABLE 3

| | As-cast (V) | HT to Peak (V) |
|---|---|---|
| Cast 6061 | −0.60 | −0.60 |
| HT alloy 4 | −1.47 | −1.42 |
| HT alloy 5 | −1.30 | −1.31 |
| HT alloy 7 | −1.42 | −1.41 |
| HT alloy 8 | −1.30 | −1.30 |
| HT alloy 10 | −1.28 | −1.35 |
| HT alloy 11† | −1.32 | −1.29 |
| HT alloy 13 | −1.28 | −1.27 |
| HT alloy 14 | −1.28 | −1.32 |
| HT alloy 15 | −1.30 | −1.32 |

TABLE 3-continued

| | As-cast (V) | HT to Peak (V) |
|---|---|---|
| HT alloy 19 | −1.29 | −1.36 |
| HT alloy 20* | −1.31 | −1.32 |

†Galvanic corrosion potential was found to increase slightly as bubbling proceeded.
*Galvanic corrosion potential was unstable, thus making the measurement unreliable.

DESCRIPTION OF FURTHER EMBODIMENTS

Although the alloys disclosed and claimed herein are not limited in utility to oilfield applications (but instead may find utility in many applications in which hardness (strength) and degradability in a water-containing environment are desired), it is envisioned that the alloys disclosed and claimed herein will have utility in the manufacture of oilfield devices. For example, the manufacture of plugs, valves, sleeves, sensors, temporary protective elements, chemical-release devices, encapsulations, and even proppants.

In addition, it may be desirable to use more than one alloy as disclosed herein in an apparatus. It may also be desirable in some instances to coat the apparatus comprising the alloy with a material which will delay the contact between the water-containing atmosphere and the alloy. For example, a plug, dart or ball for subterranean use may be coated with thin plastic layers or degradable polymers to ensure that it does not begin to degrade immediately upon introduction to the water-containing environment. As used herein, the term degrade means any instance in which the integrity of the alloy is compromised and it fails to serve its purpose. For example, degrading includes, but is not necessarily limited to, dissolving, partial or complete dissolution, or breaking apart into multiple pieces.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

I claim:

1. An age hardenable and water degradable aluminum alloy, comprising:

a. about 0.5-8.0 wt. % Ga;

b. about 0.5-8.0 wt. % Mg; and c. about 0.1-2.1 wt. % In, wherein said alloy is subjected to solution annealing and further age hardening in order to form fine precipitates.

2. The alloy of claim 1 comprising:

a. about 1.0-6.0 wt. % Ga;

b. about 2.0-6.0 wt. % Mg;

c. about 0.1-1.0 wt. % In; and d. about 0.1-4.5 wt. % Zn.

3. The alloy of claim 1 further comprising at least one metal or substance that is insoluble in the alloy.

4. The alloy of claim 3 further comprising tin and bismuth.

5. The alloy of claim 3 wherein the at least one metal comprises less than about 2.5 wt. %.

6. A flow control device comprising at least one part comprising the alloy of claim 1.

7. A device comprising the alloy of claim 1, wherein the device is selected from the group consisting of petroleum production devices, carbon sequestration devices, water production devices, and water injection devices, and geothermal power generation devices.

8. A device for use in an aquatic environment comprising the alloy of claim 1.

9. An apparatus comprising the alloy of claim 1.

10. The apparatus of claim 9 further comprising a coating which protects at least part of the apparatus from contact with water.

11. The alloy of claim 1 having a Vickers hardness of at least 75.

12. An age hardenable and water degradable aluminum alloy, consisting essentially of:

a. about 0.5-8.0 wt. % Ga;

b. about 0.5-8.0 wt. % Mg; and c. about 0.1-2.1 wt. % In, wherein said alloy is subjected to solution annealing and further age hardening in order to form fine precipitates.

13. The alloy of claim 12 consisting essentially of:

a. about 1.0-6.0 wt. % Ga;

b. about 2.0-6.0 wt. % Mg;

c. about 0.1-1.0 wt. % In; and d. about 0.1-4.5 wt. % Zn.

14. The alloy of claim 1, wherein the weight ratio of magnesium-to-gallium is between 0.5 and 3.5.

15. The alloy of claim 1, wherein the weight ratio of magnesium-to-gallium is between 1.0 and 2.1.

16. The alloy of claim 1, wherein the alloy is shaped into an oilfield device employed in a subterranean environment.

17. The alloy of claim 1, wherein the alloy is shaped into a plug employed in a subterranean environment.

18. The alloy of claim 1, wherein the alloy is shaped into a dart employed in a subterranean environment.

19. The alloy of claim 1, wherein the alloy is shaped into a ball employed in a subterranean environment.

* * * * *